US005273406A

United States Patent [19]

Feygin

[11] Patent Number: 5,273,406

[45] Date of Patent: Dec. 28, 1993

[54] PRESSURE ACTUATED PERISTALTIC PUMP

[75] Inventor: Ilya Feygin, Westfield, N.J.

[73] Assignee: American Dengi Co., Inc., Westfield, N.J.

[21] Appl. No.: 758,749

[22] Filed: Sep. 12, 1991

[51] Int. Cl.[5] ..... F04B 43/10

[52] U.S. Cl. ..... 417/474; 417/479

[58] Field of Search ..... 417/474, 478, 479

[56] References Cited

U.S. PATENT DOCUMENTS

| | | | |
|---|---|---|---|
| 2,246,772 | 6/1941 | Abercrombie | 417/474 |
| 2,291,912 | 8/1942 | Meyers | 417/474 |
| 3,194,170 | 7/1965 | Ulbing | 417/474 |
| 3,429,266 | 2/1969 | Jones | 417/474 |
| 3,701,618 | 10/1972 | Wall | 417/478 |
| 4,076,467 | 2/1978 | Persson | 417/478 |
| 4,184,811 | 1/1980 | Schade | 417/478 |
| 4,452,572 | 6/1984 | Evrard | 417/478 |
| 4,789,016 | 12/1988 | Mimail | 417/478 |
| 4,982,903 | 1/1991 | Jamison et al. | 417/477 |

FOREIGN PATENT DOCUMENTS

| | | | |
|---|---|---|---|
| 894503 | 7/1949 | Fed. Rep. of Germany | 417/474 |

*Primary Examiner*—Richard A. Bertsch
*Assistant Examiner*—Peter Koryinyk

[57] ABSTRACT

A pneumatically actuated pumping device contains three or more tubular bladders enclosed in rigid jackets and interconnected through openings at both ends forming a common internal pumping channel. Every tubular bladder is enclosed in a separate coaxial jacket, equipped with a special pressure port to assure an access to the internal volume between the jacket and the bladder. Each combination of the bladder and the jacket represents one actuating segment of the pumping device. An independent pneumatic controller distributes a predetermined pattern of a pressure and vacuum pulses through the pressure port and into the enclosed volume between the jacket and the bladder of each individual segment, providing for a selective collapse of the bladders. Every actuating segment, while collapsing, produces either a bidirectional propelling or valving action. The properly selected sequence of distribution of the pressure and vacuum pulses assures a corresponding closing and opening of actuating segments, providing a desired pumping action in a chosen direction with a preselected speed and pressure. Restoration of the collapsed bladders is assured by the resilience of the bladder material, and can be additionally assisted by providing a pulse of negative pressure into the volume between the bladder and the jacket.

4 Claims, 3 Drawing Sheets

PRESSURE ACTUATED PERISTALTIC PUMP

BACKGROUND OF THE INVENTION

This invention relates to a group of pumping devices with a flexible actuating member, especially to bladder, diaphragm and peristaltic pumps, and, partially, to the pumps with a flexible rotating actuator.

THE RELATED ART

A variety of pumping mechanisms with a flexible actuating member were introduced through the years in order to provide an efficient and controllable pumping action with a minimum number of moving parts, limited influence on the transferred media, isolation of the aggressive or sterile transferable media from the environment arid ability to handle solids, semisolids and liquids with different viscosities.

Heretofore three main types of flexible pumping actuators are being evaluated.

Diaphragm and bladder type actuation provides a fully controllable pressure of the pumping action, utilizing an intake and an exhaust valve and a limited motion or deflection of the flexible actuating member. The very existence of two valves limits the application of these devices to a very clean, low viscosity liquids, which should be able to tolerate the constant mechanical impact of valving mechanisms. Utilization of valves also excludes the possibility of reversing the flow without changing the setup. Typical pressure actuated bladder pump with multiple valves is presented in a U.S. Pat. No. 4,047,849 "Pneumatic Pulsator Pumping System With Pulsator Fluid Venting Valve". Widely used "peristaltic" pumps utilize elastic tubing as the liquid carrier, and are actuated by a roller, which longitudinally squeezes the tubing against the rigid support. The pumping action can be reversed only if the system is equipped with a reversible motor. Limited suction is provided by the resilient restoration of the tubing material, which follows the roller impact. Time, required for the tubing restoration is the main performance limiting factor. Also, any actuating roller will, by definition, compress not only the tubing, but anything inside the tubing as well, which narrows the application of this device to pumping of a limited range of low viscosity liquids. Furthermore, the constant roller impact not only shortens the life span of the tubing, but also requires a substantial actuating power.

Pumps with a flexible rotating actuator can provide a large pumping volume by moving portions of liquid, accumulated between the blades of the actuator, in a centrifugal motion from the intake to the exhaust port. These pumps in general do not require valves but the rotating actuator itself can tolerate only a limited amount and size of impurities in the liquid, can not permit extended dry running and has the strongest destructive effect on the transferrable media.

It would be highly desirable, therefore, to have a pumping device, which will have no adverse chemical or mechanical effect on the transferred media, will provide complete isolation of this media from the environment, will be able to handle liquids with different viscosities, solids and semisolids, and will have no valves or rotating parts, thus providing a fully controllable pumping action of infinitely variable volume, speed and pressure, instantaneous reversing of the flow, and unlimited dry running capabilities.

Accordingly, an object of the present invention is to provide a pumping device without valves or rotating parts to assure higher reliability and extended life.

Another object of the present invention is to provide a pumping device with a constant and unobstructed cross-section of the pumping channel which eliminates clogging of the pump by any type of impurity present in the transferred media.

A further object of the present invention is to provide a pumping device with a soft wall type internal channel for assuring a non-destructive pumping process.

A still further object of the present invention is to provide a fully controllable pumping action with infinitely adjustable delivery rates and pressures.

A still further object of the present invention is to provide a self-priming pumping device with an adjustable suction lift.

A still further object of the present invention is to provide a pumping device with unlimited dry running potential.

A still further object of the present invention is to provide a pumping device with immediate flow reversing capability.

Among the advantages offered by the present invention is a pumping mechanism which incorporates not only features from non-pumps such as differential flexible actuators but also eliminates their shortcomings and, at the same time, introduces such unique parameters as non-destructive transfer of any organic, live or inorganic bodies, total elimination of valves or rotating parts and infinite control and adjustment of all pumping parameters, including flow direction. fitting in a wall thereof providing the ability for introducing or removing a pressure fluid, which may be in gas or liquid form, the jacket having an input and an output opening end opposite one another;

a tubular flexible walled bladder extending coaxially inside the jacket;

a pair of bushings within the bladder at opposite ends thereof for supporting and sealing the bladder against the input and output opening ends of the jacket, the bladder having sufficient length to extend beyond each of the respective bushings and jacket ends to form an open mouth;

at least one interconnecting pipe segment connecting two of the actuating segments to form a common internal pumping channel, the pipe segment having ends receivable in the open mouth of the bladder; and a device for selectively distributing an externally generated pressure fluid through the pressure fitting into an area between the bladder and the housing jacket to induce a predetermined collapsing or recuperation pattern with the bladder thereby transporting the substances through the internal pumping channel.

BRIEF DESCRIPTION OF THE DRAWING

The objects, advantages and features of the invention will better be understood with reference to selected embodiments given only by way of example and illustrated in the accompanying drawings wherein.

DETAILED DESCRIPTION

Description and Operation of Actuating Segment

Figure 1:
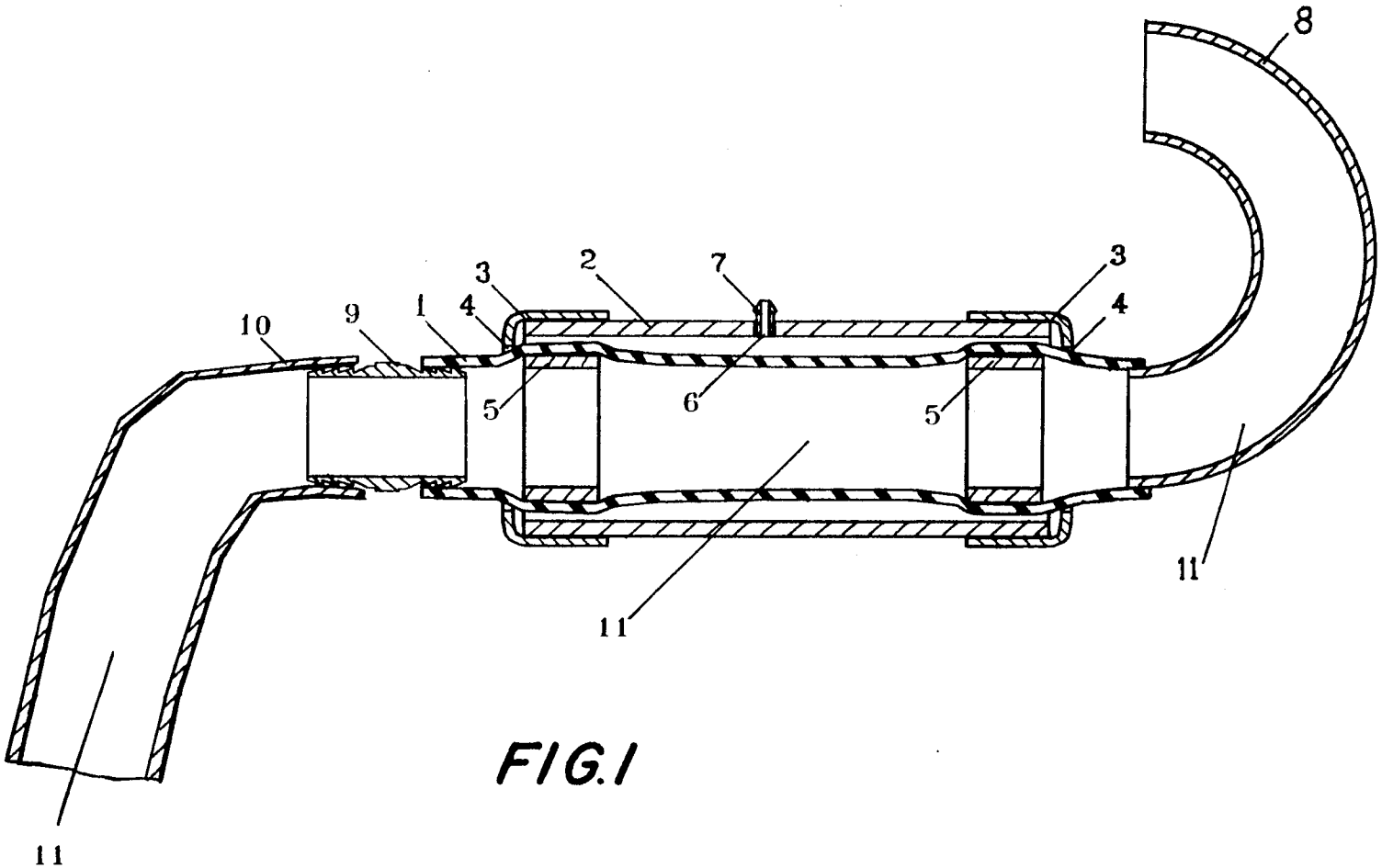
FIG. 1 illustrates one of a multitude of identical actuating segments of the pumping device.

FIG. 1 shows one actuating segment of a multi segment pumping device according to the preferred embodiment of the invention. Actuating segment consists of a tubing type bladder 1, located coaxially inside the cylindrically shaped housing jacket 2, which is shorter than the tubing type bladder and has an internal diameter slightly larger than title outer diameter of the tubing type bladder 1. The housing jacket 2 is terminated on both ends with rigidly attached caps 3, which are individually equipped with a centered opening of the end cap 4 equal to the OD of the tubing type bladder 1. Both of these centered openings 4 of the corresponding end caps 3 assure free passage of the tubing type bladder 1 through the entire housing assembly, comprised of the housing jacket 2 and two end caps 3. Two internal supporting/sealing bushings 5 with their outer diameter slightly larger then the diameter of the centered openings of the end caps 4, and an internal diameter equal to that of the internal diameter of the tubing type bladder 1, are forcefully inserted into the tubing type bladder and are located at both ends of the housing jacket 2, pressing said tubing type bladder I against the inner surfaces of both terminating end caps 3. Housing jacket 2 has a pressure opening 6 located on its cylindrical surface, equipped with a pressure fitting 7. Any side of the tubing type bladder 1 can be connected through the interconnecting barbed fitting 9 to the intake/exhaust tubing 10 or to another tubing type bladder 1 of an identically constructed adjacent segment, through an interconnecting pipe segment 8. Inner surface of the tubing type bladder 1, together with the inner surface of a supporting/sealing bushings 5, inner surface of the barbed fitting 9, inner surface of the intake/exhaust tubing 10 and inner surface of the interconnecting pipe segment 8, comprise an internal channel 11 with a constant cross section.

Figure 2:
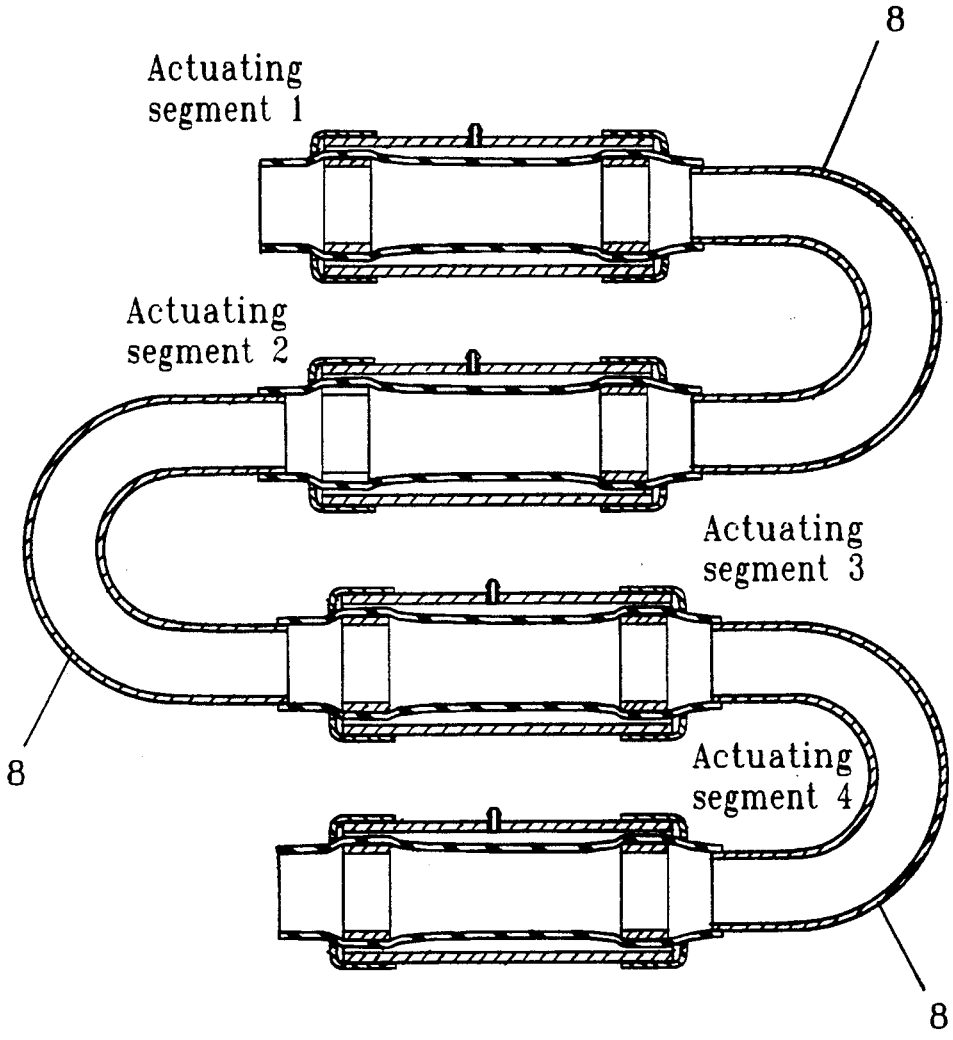
FIG. 2 illustrates four intra-connected actuating segments with a common internal channel.
Figure 3:
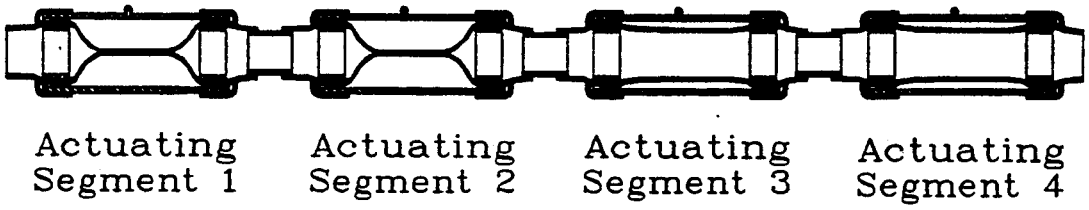
FIG. 3 illustrates the beginning of a pumping cycle with pneumatically activated first two segments.
Figure 4:
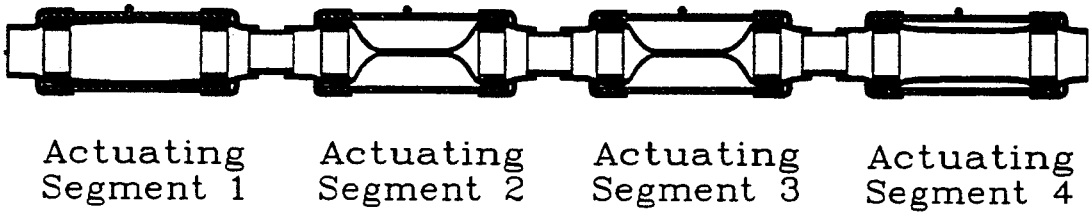
FIG. 4 illustrates a second phase of the pumping cycle with pneumatically activated second and third segment and vacuum assisted recuperation of the first segment.
Figure 5:
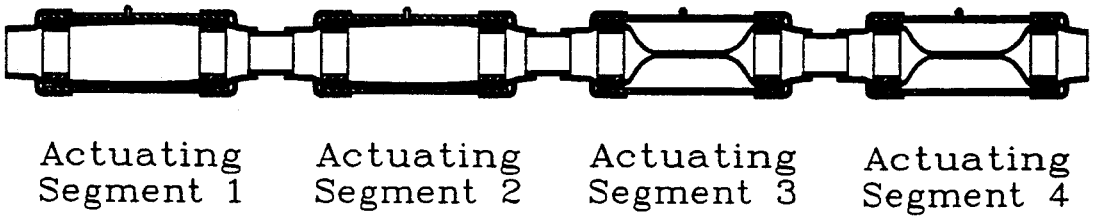
FIG. 5 illustrates a third phase of the pumping cycle with a pneumatically activated third and fourth segment and vacuum assisted recuperation of the first and second segment.
Figure 6:
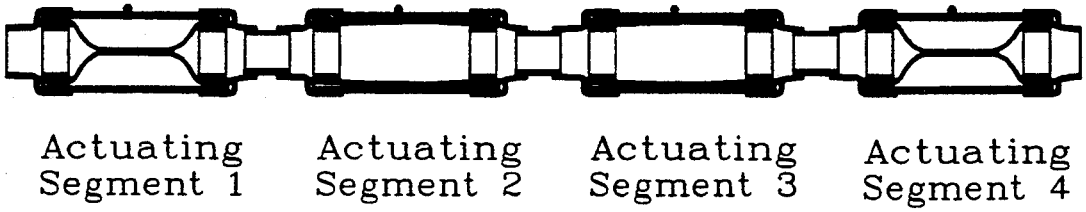
FIG. 6 illustrates a fourth and last phase of the pumping cycle with a pneumatically activated fourth and fifth segment and vacuum assisted recuperation of the second and third segment.

FIG. 2 shows a complete, four segment pumping device, where the tubing type bladder of each individual actuating segment is connected to an identical tubing type bladder of the adjacent segment through an interconnecting barbed fitting. This provides all four segments with a common internal channel of a constant cross section. Free outer ends of the outer segments can be connected to any type of an intake or exhaust tubing, if necessary.

Description and Operation of Actuating Segment

The actuating segment, shown on FIG. 1, is a stand alone component of a multisegment pumping device, shown on FIG. 2. Every segment can be activated by the pressurized air, supplied through the pressure fitting 7 into the enclosed volume between the housing jacket 2 and the outer surface of the tubing type bladder 1. Due to the appl.ed pressure, said tubing type bladder 1 starts to collapse from the point of maximum flexibility in the middle of the housing jacket 2 outward in the direction of the supporting/sealing bushings 5. This action provides a corresponding directional closure of the internal channel 11, located inside the housing jacket. Simultaneously, compressed tubing type bladder 1 will elongate, pressing the supporting/sealing bushings 5 against the end caps 3, which assures a self sealing effect, proportional to the applied pressure.

If, during the described collapsing process, the tubing type bladder 1 is filled with a fluid, this fluid will be displaced out of the collapsing zone between the supporting/sealing bushings 5 and into the intake/exhaust tubing 11 or into the interconnecting pipe segment 8 and further into the tubing type bladder 1 of an attached adjacent segment. If the fluid inside the tubing type bladder 1 includes any solid or semisolid particles, these particles will be either pushed out or enveloped by the tubing type bladder 1. Both cases will eventually result in total closure of the internal channel of the actuating segment. Therefore the actuating segment can serve simultaneously as a propelling component or as a pneumatically operated valve. This dual functionality of each individual actuating segment is essential to the overall operation of the multi-segment pumping device illustrated in FIG. 2 through FIG. 6. Release of the pressure is conducted through the same pressure fitting 7, which allows for the gradual restoration of the tubing type bladder 1 to its original shape due to the resiliency of the tubing material. Accelerated recuperation of the tubing type bladder 1, as well as it's additional enlargement within the limitations of the internal volume of the housing jacket 2, is possible if certain negative pressure will be applied through the same pressure fitting 7. Both the inherent resiliency of the tubing type bladder 1 or the vacuum assisted restoration of the internal channel 11 will provide a suction capability into the actuating segment. The higher viscosity or the suction lift of tile transferred media, the larger is the required assist by the negative pressure (vacuum). The aforementioned suction of the actuating segment ensures the self priming capability of the pumping device.

Description and Operation of Multisegment Pumping Device

Multisegment pumping device, shown on FIG. 2 consists of four identical actuating segments with a common internal channel of constant diameter, serially interconnected through the interconnecting pipe segment 8. Selected "U" shape of the interconnecting pipe segment is for compactness of the multisegment pumping device.

While three actuating segments can actually provide a working pump, a four segment pumping device represents the minimum number of components required to afford all the advantages of this technique. Each actuating segment, presented on FIG. 2 through FIG. 6 is marked sequentially as Segment 1 through Segment 4.

Actuating segments are activated by a predetermined pattern of the pressure pulses, generated by an external pneumatic controller. One of the possible four step sequences is shown on FIG. 3, FIG. 4, FIG. 5 and FIG. 6. The collapse of the first and second actuating segments, shown on FIG. 3, prepares the pumping device for the operation by starting to squeeze the air out of the internal pumping channel. If liquid were already in the system, it will be forced out of the first two actuating segments. Second step of activation is shown on FIG. 4, where the first actuating segment is recuperating, providing suction into it's internal channel, whereas the second actuating segment is still closed and serves temporarily as a check valve, while the third actuating segment propels the liquid or air further in the direction of pumping. The third step of the pumping sequence, shown on FIG. 5, advances the pumping process by energizing the fourth actuating segment, forcing the liquid out of the pump, while the second actuating segment recuperates and provides an additional intake, whereas the third actuating segment serves as a temporary valve. Last step of this four step activating sequence is shown on FIG. 6, where the fourth actuating segment serves as a valve, the third actuating segment provides suction through the recuperation and the first actuating segment closes and locks the portion of the liquid inside the pumping channel. The following step will just repeat the first step, shown on FIG. 3. The entire sequence can be stopped or reversed at any moment, providing complete control over the pumping process. The supplied values of the actuating pressure and vacuum, as well as the timing of the pressure pulses are fully adjustable in order to control all of the pumping parameters. Actuating air pressure will determine the pumping pressure, while the vacuum, which assists in the recuperation process, will determine the maximum suction lift, whereas the frequency of the pressure to vacuum transitions will determine the operating speed or flow of the pumping device. Thus the reader can see that this pressure activated pumping device provides simultaneously a number of unique pumping parameters, some of which were never available before, while others were available as a part of various different pumping techniques. Among the most special qualities is the ability to handle any media from hard stones to soft berries without any damage either to the pump or to the transferred media. As a corollary to this feature, this device can be furnished with a variety of active or passive inserts, located inside the pumping channel, and serving many different purposes, including heating, measuring, injecting and, also, coaxial pumping. This action can be achieved by placing a similar, but smaller diameter pumping device inside the pumping. channel. Another special characteristic is the capability of this device to generate either a high pressure spray, or one drop on demand delivery, without any rotating parts or valves. Constant cross section of the internal pumping channel allows, if necessary, for free syphoning of the transferrable media through the pump, or, on the contrary, an immediate squeeze and blockage of this channel by any number of the selected activating segments. Constant cross section of the pumping channel makes clogging and occlusion of the system very unlikely. Utilizing a certain pattern of the pressure pulses, distributed to the actuating segments, it is always possible to use the first actuating segment as a dedicated intake valve, the last actuating segment as a dedicated discharge valve and all of the simultaneously energized internal actuating segments as a main pumping component, which will allow to reproduce the pumping pattern of a regular piston type pump.

While my above description contains many specificities, these should not be construed as limitations on the scope of the invention, but rather as an exemplification of one preferred embodiment thereof. For example, the actual design of the actuating segment cart be implemented using adhesives, thermal fusion, compression or any other technique of attaching different types of the bladder forming flexible members to the housing jacket. It is also conceivable, and sometimes even advantageous, to supply a common flexible or rigid jacket for any number or all of the actuating bladders, providing either art additional flexibility, higher structural strength or better mounting convenience.

I claim:

1. A pumping device for transferring substances comprising:

a plurality of actuating segments each comprising:

an elongated housing jacket including a pressure fitting in a wall thereof providing means for introducing or removing a pressure fluid, said jacket having an input and an output opening end opposite one another;

a tubular flexible walled bladder extending coaxially inside said jacket;

a pair of rod end caps with centered openings rigidly attached to the input and outlet openings of said jacket; and a pair of bushings within said bladder at opposite ends thereof for supporting and sealing said bladder against said input and output opening ends of said jacket, said bladder having sufficient length to extend beyond each of said respective housing jackets, said bushings and said end caps to form an open mouth;

at least one interconnecting pipe segment connecting two of said actuating segments to form a common internal pumping channel, said interconnecting pipe segment having ends receivable in said open mouth of said bladder; and a means for selectively distributing an externally generated pressure fluid through said pressure fitting into an area between said bladder and said housing jacket to induce a predetermined collapsing or recuperation pattern with said bladder thereby transporting said substances through said internal pumping channel.

2. A pumping device according to claim 1, wherein said pressure fluid is selected from the group consisting of a liquid, compressed air and a vacuum.

3. A pumping device according to claim 1, wherein are present at least four actuating segments and at least three interconnecting pipes.

4. A pumping device according to claim 1, wherein said at least one interconnecting pipe is U-shaped.

* * * * *